United States Patent [19]

Young

[11] Patent Number: 5,033,747

[45] Date of Patent: Jul. 23, 1991

[54] GOLF TEE ASSEMBLY WITH REUSABLE GOLF TEES

[76] Inventor: Dennis R. Young, 1093 Evenstar Ave., Westlake Village, Calif. 91361

[21] Appl. No.: 517,858

[22] Filed: May 2, 1990

[51] Int. Cl.[5] ..... A63B 69/36; A63B 57/00

[52] U.S. Cl. ..... 273/195 R; 273/202; 273/208

[58] Field of Search ..... 273/32.5, 33, 195 R, 273/201-212, 196-200, 185 C, 185 D; 119/121, 122, 123

[56] References Cited

U.S. PATENT DOCUMENTS

| | | | |
|---|---|---|---|
| D. 78,587 | 5/1929 | Roop | D21/208 |
| D. 239,123 | 3/1976 | Reed et al. | D21/208 |
| 654,666 | 7/1900 | Newton | 273/209 |
| 1,542,514 | 6/1925 | Mahony | 273/203 |
| 1,636,655 | 7/1927 | Young | 273/33 |
| 1,638,448 | 8/1927 | Manson | 273/209 |
| 1,650,141 | 11/1927 | Lowell | 273/203 X |
| 1,670,123 | 5/1928 | Ranseen | 273/209 X |
| 1,675,335 | 7/1928 | Drevitson | 273/202 |
| 1,692,233 | 11/1928 | Van Patten | D21/209 X |
| 1,779,995 | 10/1930 | Trane | 273/203 |
| 1,815,520 | 7/1931 | McLeod | 273/33 |
| 1,823,992 | 9/1931 | Smith | 273/209 |
| 1,936,625 | 11/1933 | Goldman | 273/203 |
| 2,159,893 | 5/1935 | Hansen | 273/208 |
| 2,509,166 | 5/1950 | Phillips et al. | 273/204 |
| 2,790,419 | 4/1957 | Sullivan | 119/121 |
| 3,100,476 | 8/1963 | Peak | 119/121 |
| 3,112,111 | 11/1963 | Bennett | 273/203 |
| 3,658,037 | 4/1972 | Hunter | 273/200 R X |
| 4,095,798 | 6/1978 | Marple | 273/185 C X |

FOREIGN PATENT DOCUMENTS

| | | | |
|---|---|---|---|
| 9947/32 | 10/1933 | Australia | 273/208 |
| 25767 | of 1908 | United Kingdom | 273/204 |
| 248295 | 3/1926 | United Kingdom | 273/208 |
| 240906 | 5/1928 | United Kingdom | 273/208 |
| 588723 | 6/1947 | United Kingdom | 273/208 |

*Primary Examiner*—William H. Grieb
*Assistant Examiner*—Sebastiano Passaniti
*Attorney, Agent, or Firm*—Christie, Parker & Hale

[57] ABSTRACT

A golf tee assembly with at least one reusable tee attached remote from a retaining member which is anchored to a teeing ground surface.

10 Claims, 5 Drawing Sheets

EXAMPLES OF TEE CONFIGURATIONS

GOLF TEE ASSEMBLY WITH REUSABLE GOLF TEES

BACKGROUND OF THE INVENTION

The present invention relates to a golf tee assembly and, more particularly, to a golf tee assembly with reusable golf tees. Still more particularly, the invention concerns a golf tee assembly which may be used with practice tees on teeing ground surfaces including synthetic grass or rubber mats such as are common at driving ranges.

Golfers often find it desirable to practice their strokes and, generally, such practice takes place at driving ranges. Of course, practice is not limited to driving ranges and may take place at any suitable location. In undertaking practice, golfers would prefer to simulate conditions encountered during golf play. Typically, however, practice at driving ranges is limited to practice tees of singular orientation.

Since a relationship exists between the golf club used and the vertical elevation of the golf ball in play, practice at driving ranges is limited. That is to say, in different situations in actual play the height of the golf ball from the ground is varied and the selection of a particular golf club depends in part on the vertical elevation of the golf ball. For example, in teeing off at commencement of play of each hole, the ball is usually placed on a golf tee which, for all practical purposes, represents the highest elevation of golf ball placement. At the opposite extreme, golf ball location in a sand trap, represents a golf ball at one of its lowest elevations from the ground. Intermediate conditions exist when the golf stroke takes place on a fairway or in any location where grass of different height may be encountered.

It is desirable, for golfers to be able to practice their strokes under different conditions to simulate those that may be encountered during play. With the usual practice tees at a driving range, only a single golf ball placement device is usually available; typically in the form of a hollow rubber cylinder secured to the teeing ground surface, (generally a simple artificial grass mat or carpet). The practice tee must be secured adequately to avoid displacement when the golf ball is stroked. The term "practice tee" as used herein refers to the kind often found at practice ranges which comprises a hollow cylindrical member that extends upwardly through a hole in the carpet or mat and a horizontal flange that remains under the mat or carpet to secure the cylindrical member.

It is desirable to provide a golf tee assembly which provides golf tees of varying vertical elevation but which are secured in such a way as to not result in loss or destruction of the golf tee, so that the golf tees may be reused. However, it is also desirable to provide a golf tee assembly of the type described which is portable and which may be easily arranged for use and removal after use.

Golf tees have been proposed for providing adjustable height or elevation to accommodate different practice or playing conditions. One such example, may be found in Young, U.S. Pat. No. 1,636,655 which describes a truncated rubber cone constructed with a circumferential bead that may serve as a base if one section of the tee is removed. The height of the golf tee may be changed by removing one section of the tee.

Another arrangement is described in Mahony U.S. Pat. No. 1,542,514 which describes a golf tee mat having built therein golf tees of varying heights. The mat has a plurality of rows of tees extending across and spaced apart to permit each tee to support a golf ball and the golf tees in the row may vary in vertical elevation, i.e., height. In another arrangement described in Drevitson U.S. Pat. No. 1,675,335, a golf tee is described as being formed of an arcuate strip of flexible sheet which has ends that overlap to form a hollow cone frustrum. By varying the degree of overlap of the ends of the strip, the vertical elevation may be adjusted. Van Patten U.S. Pat. No. 1,692,233 describes a fixed, triangular-shaped plate with golf tees at the apices that may vary in height. A similar structure is disclosed in Design Patent 239,123 to Reed et al. In the latter two devices the golf tees are connected to each other.

Portable golf tees have been proposed which typically include a golf tee attached to a weight or other heavy object intended to avoid loss of the golf tee after use. Typical of such arrangements are those described in Newton U.S. Pat. No. 654,666, Ranseen U.S. Pat. No. 1,670,123, Smith U.S. Pat. No. 1,823,992, and Roop U.S. Design Pat. No. 78,587. Alternative means for fastening the tee so as to avoid its loss following use are described in Trane U.S. Pat. No. 1,779,995 and Lowell U.S. Pat. No. 1,650,141. The Trane patent includes two connected golf tees which may be secured by an anchoring pin in the middle.

It is apparent that the construction of golf tee assemblies has not progressed significantly over the years as evidenced by the age of the above described patents.

SUMMARY OF THE INVENTION

The present invention provides a novel golf tee assembly with reusable golf tees that may be used on a variety of teeing ground surfaces and which is also useable with conventional practice tees found on common driving ranges.

In accordance with the present invention there is provided a golf tee assembly with reusable golf tees for use on a teeing ground surface which comprises at least one golf tee, a retaining member, flexible attaching means to attach the golf tee to the retaining member remote therefrom and anchor means to secure the retaining member to a teeing ground surface. In a preferred embodiment, the invention comprises a plurality of golf tees of different vertical elevation attached in the manner described to a retaining member. In the embodiment preferred for use with a practice tee, the invention comprises the golf tee assembly described in combination with a vertically extending practice tee having a hollow cylindrical member. The anchor means, which preferably comprises an elongated shaft with a tapered end portion and a grasping end portion, is inserted into the hollow cylindrical member with the tapered end portion wedged therein to form a tight fit. The shaft serves to stiffen the hollow cylindrical member, which is usually made of rubber. When the retaining member is in the form of an annular ring, the shaft also serves to anchor the retaining ring in place around the hollow cylindrical member which is maintained in place by the grasping portion of the elongated shaft which would be of a cross section larger than the cross section of the hole or opening in the retaining ring.

Preferably, the golf tee assembly comprises a plurality of, unconnected individual golf tees of different vertical elevation, i.e., not directly connected to each other. Each tee has an upper surface configured to support a golf ball which may be placed thereon and is constructed so as to be able to be laid upon the teeing ground surface, e.g. the ground or rug or mat, without the need to be individually secured to the ground. The retaining ring is provided with sufficient individual holes along the perimeter so that each golf tee may be separately attached to the ring by suitable flexible attaching means, such as string, cord, twine, etc. Thus, the flexible attaching means is fixed at one end to the retaining ring and at the other end to a golf tee. The anchoring means, such as the elongated shaft described above, is insertable through the hole of the annular retaining ring for securing the golf tee retaining means to the teeing ground surface. The anchoring means preferably comprises an elongated shaft with a tapered piercing end portion and an opposite grasping end portion. The piercing end facilitates penetration into the teeing ground surface to connect the shaft thereto and the grasping end serves to retain the golf tee retaining means around the shaft as well as to enable the application of sufficient force for connection of the shaft to, and removal from, the teeing ground surface.

In the preferred embodiment, the golf tee assembly is combined with the hollow cylindrical member of a practice tee that is fixed to the teeing ground surface, e.g. rug or mat, and extends through the hole in the retaining ring. The piercing end of the elongated shaft is inserted into the hollow cylindrical member so as to form a friction fit therewith and the grasping end of the elongated shaft acts to secure the retaining ring around the practice tee so it won't lift off when a golf ball is hit off one of the golf tees attached to the ring.

It is apparent from the foregoing that the present invention enables golfers to practice on tees of fixed but varying heights which makes it practical to use tees of different but consistent heights on a repetitive basis.

In the presently preferred embodiment, the retaining member is advantageously an annular circular disc or ring with a hole in the middle. It may be made of rubber, wood, metal or plastic. The golf tees can also be made of rubber or plastic and can be attached to the circular disc by, for example, string, cord or thread of varying lengths, which may or may not be elasticized or also made of elastic. It has been determined that optimum length of the string or cord or flexible attaching means should be about 6 to 8 inches. The holes may be drilled or punched into the golf tees and in the retaining ring through which the string or cord can be passed. The flexible attaching means can be secured to the circular ring, for example, by simply knotting the ends of the cord to provide a cross section larger than the holes through which the string or cord pass or by other suitable means such as by crimping a pigtail at the end or heat shrinking a tubular end member thereon.

To secure the retaining ring to a teeing ground surface an anchoring means as previously described is inserted through the retaining ring and into the ground or into the hollow cylindrical member of a practice tee secured or placed in a synthetic grass or rubber mat or carpet such as may be used at golf driving ranges. The tapered shaft comprises a piercing end and an opposite grasping end. The grasping end may be conveniently a round, square or other shaped member attached to the elongated shaft but which is of sufficiently large diameter or cross section to be able to prevent the retaining ring from sliding out or off the shaft. Thus, the grasping end should be of a cross section larger than the cross section of the hole in the annular retaining ring or cylindrical disc.

The tapered shaft cross section should be such as to enable the shaft to easily pierce the ground or, in the alternative, to easily enter the hollow cylindrical member of the practice tee. However, since the tapered shaft varies in cross section, the larger end of the shaft should be sufficient to accomplish a firm friction fit within the hollow cylindrical member of the practice tee. Since the practice tees are normally made of rubber or other similarly flexible material, it is easily possible for the tapered shaft to be wedged within the hollow cylindrical member of the practice tee to a sufficient extent to make a firm connection. However, it is also important that the anchoring means or elongated shaft be easily removed by pulling on the grasping end to release the shaft from the ground or hollow cylindrical member of the practice tee when the golfer has completed its use.

It is also desirable that the cross section of the hole in the retaining ring be sufficiently larger than the outer diameter of the elongated shaft beneath the grasping end and the outer diameter of the hollow cylindrical member of the practice tee, where one is used, to enable the tee restraining means, e.g., retaining ring, to rotate freely around the anchoring means. Typically, the practice tees are constructed as shown as 40 in FIG. 1, with a vertical, hollow, cylindrical member extending upwardly from a horizontal flange of sufficient width to enable the practice tee to be anchored by projection of the hollow cylindrical member through a hole in the teeing ground surface, i.e., the synthetic grass carpet or mat, with the flange extending under the carpet or mat and sufficiently wide so it can't be easily pulled through the hole.

DESCRIPTION OF PREFERRED EMBODIMENTS WITH REFERENCE TO THE DRAWINGS

Figure 2:
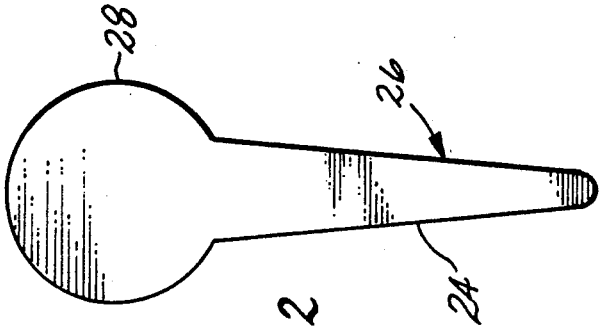
FIG. 2 is a schematic view of the anchoring means which may be used in accordance with the invention.
Figure 1:
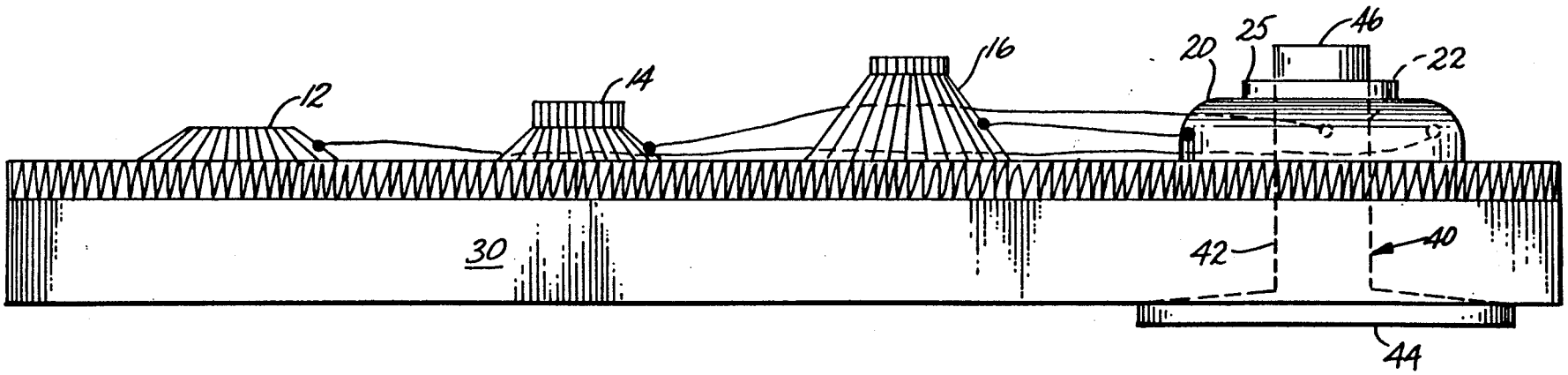
FIG. 1 is a side elevation view schematically illustrating the golf tee assembly in accordance with the invention.
Figure 3:
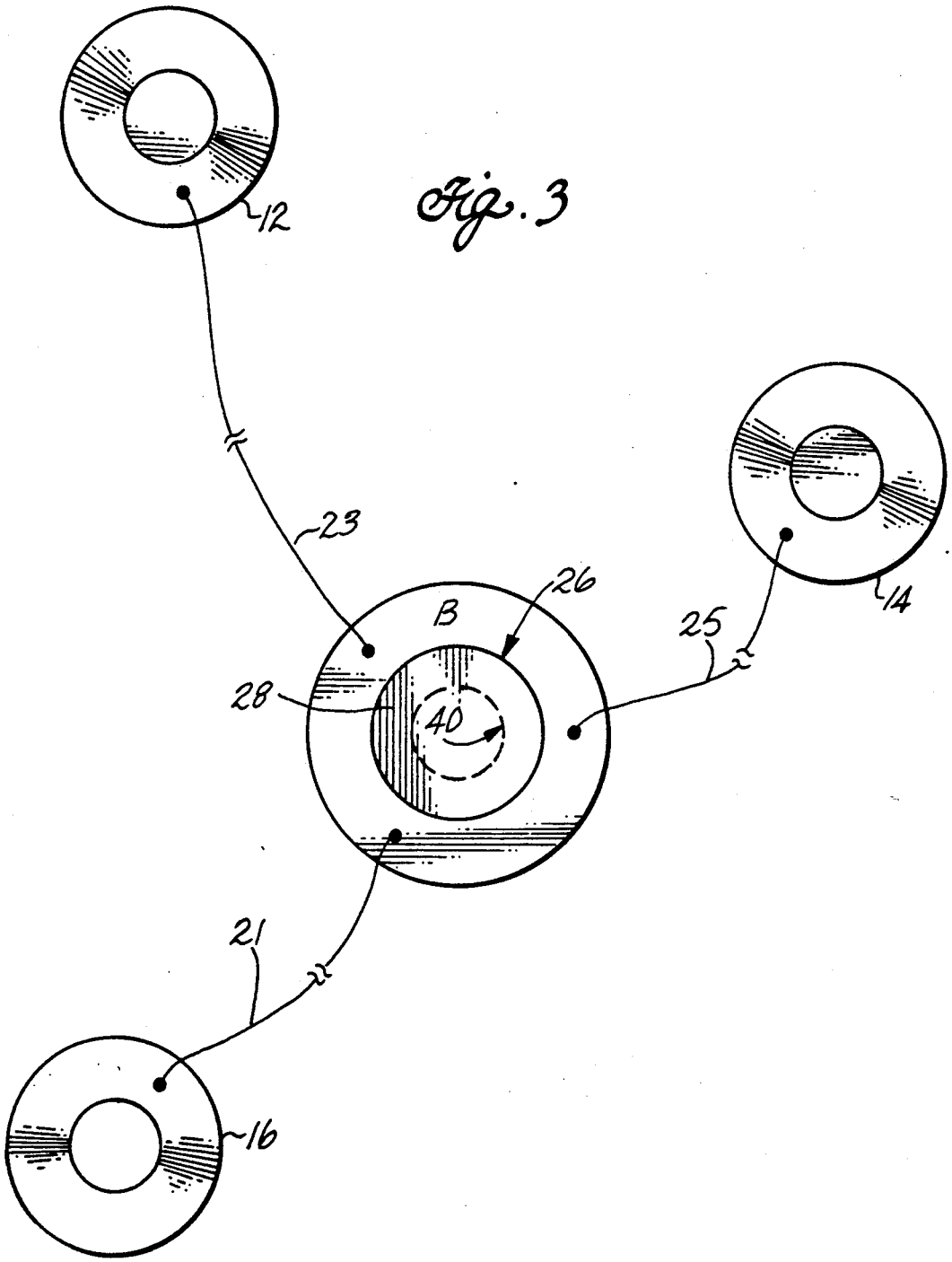
FIG. 3 is a schematic top view of the golf tee assembly of the invention.

As may be seen in FIGS. 1–3 wherein like numbers refer to like parts, a preferred embodiment of the invention comprises a plurality of golf tees 12, 14, and 16 of varying vertical elevation and an annular retaining ring 20 with a central hole 22. Anchoring means 26, shown in FIG. 2, comprises an elongated shaft with a tapered end portion 24 and a grasping end portion 28. In typical use the golf tee assembly is placed on a synthetic grass mat or carpet 30 and an especially advantageous feature of the invention is that it is able to be used with conventional practice tees 40, as shown in FIG. 1. Such practice tees are constructed with an elongated, hollow cylindrical member 42 and a wide flange base portion 44. The elongated cylindrical member 42 typically extends through a hole in the synthetic carpet or mat 30 so that it protrudes above the surface. In typical use of a practice tee, the golf ball is placed on the top surface 46 of the hollow cylindrical member from which it is stroked by the golfer in the usual fashion. Because the practice tee 40 is secured and retained by carpet or mat 30 it remains in position and can be reused.

To secure the golf tees of the invention of varying elevation in position for reuse, they are attached to the retaining ring 20 by flexible attaching means 21, 23 and 25. In an easily constructed version of the invention, the flexible attaching means may be string or cord which may be fastened to the golf tees 12, 14 and 16 as well as to the retaining ring 20 by being inserted through holes provided in the golf tees and the retaining ring. Both the tees and ring may be hollow molded plastic members and the flexible attaching means may be knotted to provide a cross section greater than the hole through which the string or cord is passed. Of course, the flexible attaching means may be connected to the golf tees and the golf tee retaining means, i.e., the retaining ring, in any other suitable manner.

The retaining ring with golf tees attached is anchored in place on a teeing ground surface in the embodiment illustrated by being placed about the hollow cylindrical member of the practice tee and the elongated tapered shaft 24 is inserted into the hollow central opening of the cylindrical member 42. Although not absolutely necessary, a washer 25 may be used to assist maintaining the retaining ring 20 in contact with the rug or mat 30. By forcing the tapered shaft of the anchoring means into the hollow cylindrical member to an extent sufficient to cause a tight fit between the shaft and the internal diameter of the hollow cylindrical member 22, the golf retaining means 20 is properly secured. It is also noted that the grasping end 28 of the anchoring means is of a cross section larger than the cross section of the hole in the retaining ring and this serves to prevent the retaining ring from being easily dislodged from the practice tee during use.

Figure 4:
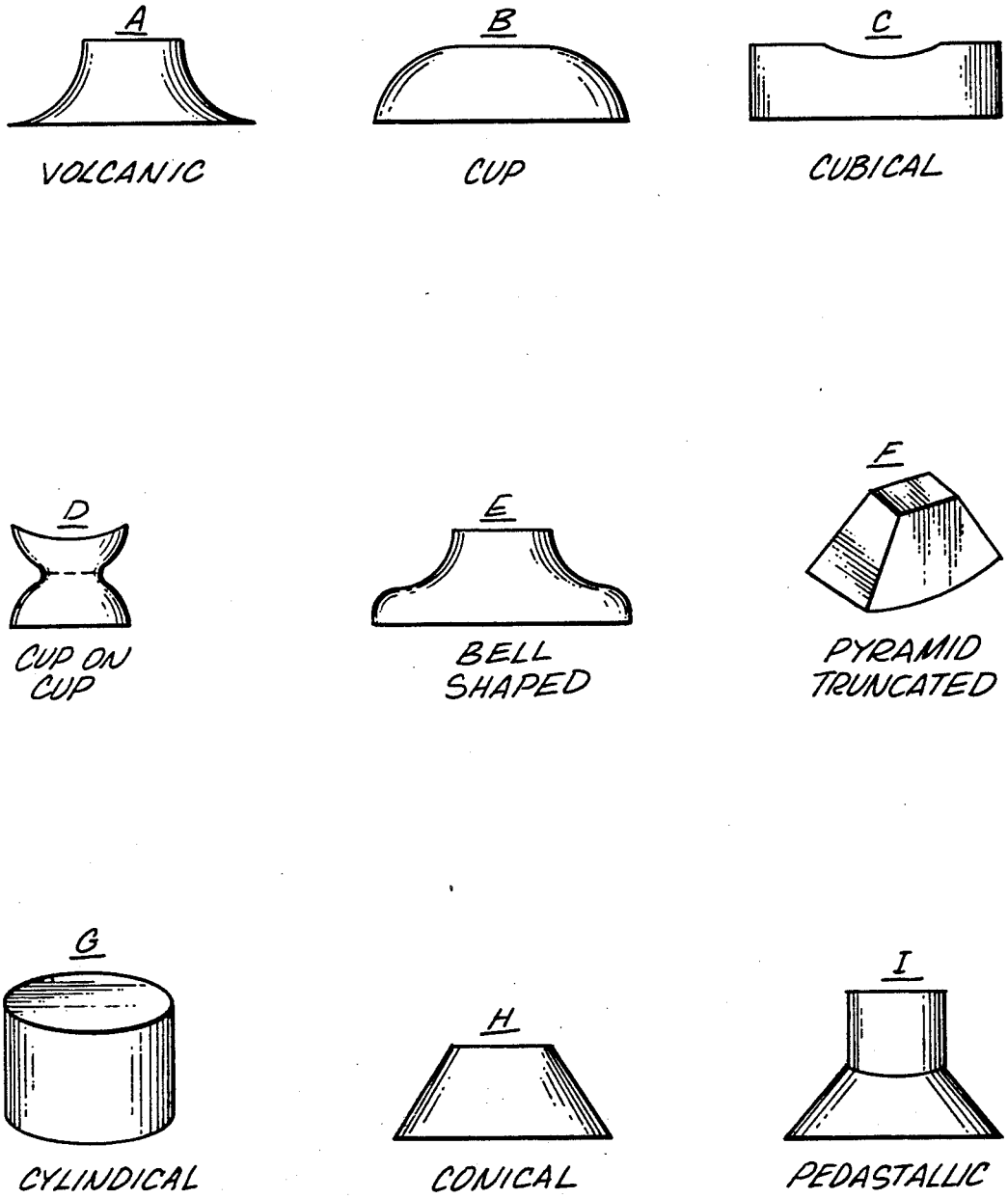
FIG. 4 are various configurations of golf tees which may be used with the invention.
Figure 5:
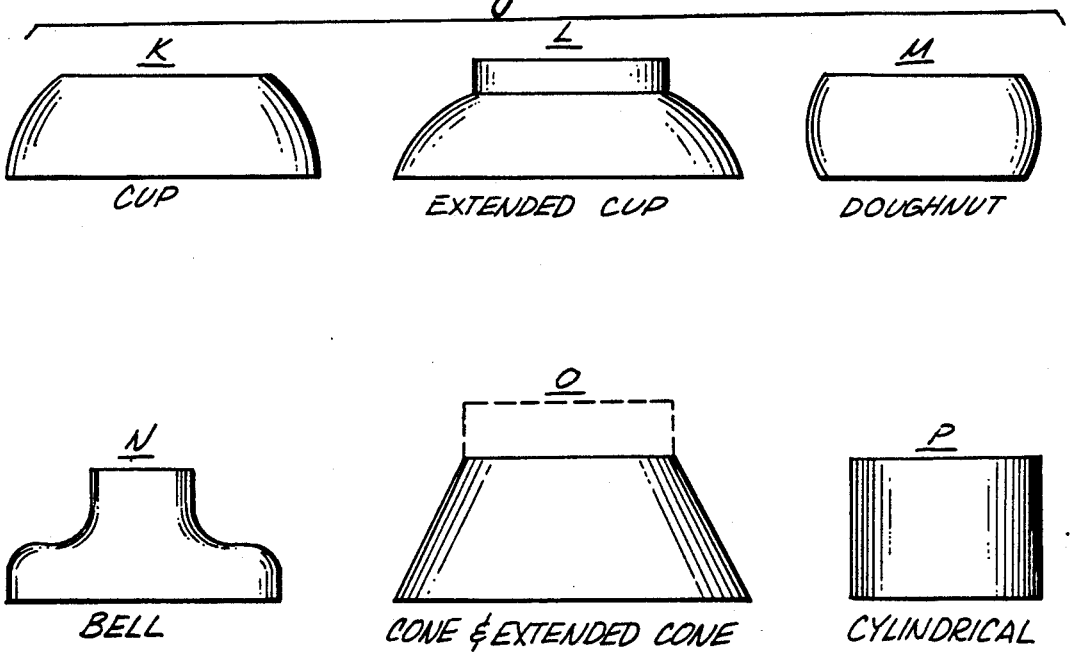
FIG. 5 are illustrations of various configurations of retaining rings useable in accordance with the invention.
Figure 6:
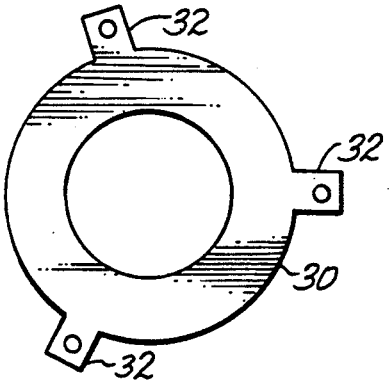
FIG. 6 is a top view of an alternate method of attaching the flexible attaching means to connect the individual golf tees to the retaining ring.
Figure 7:
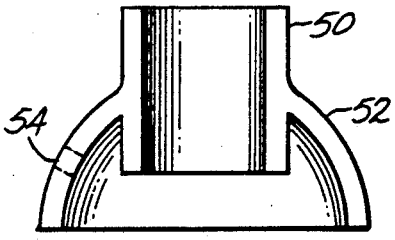
FIG. 7 is a side elevation of a retaining ring of another preferred design.

Although the configuration of the golf tees shown in FIG. 1 are truncated cones, other shapes may also be employed. Examples of other configurations which may be used for the golf tee construction are shown as A-I in FIG. 4 and include volcanic, cup, cubicle, cup on cup, bell shaped, pyramid truncated, cylindrical, conical and pedastallic forms as illustrated. Similarly, the configuration of the retaining ring may be varied and examples of some other configurations are shown as K-P in FIG. 5. These configurations include cup, extended cup, donut, bell, cone and extended cone and cylindrical forms. As indicated previously, various methods of attaching the flexible attaching means to the retaining ring may be employed. In addition to the simple string with knotted ends described in connection with the embodiment illustrated in FIGS. 1-3, the retaining ring 30 may be constructed as shown in FIG. 6. In these illustrations, separate extended flanges 32 are used to which the flexible attaching means may be secured. Another retaining ring configuration which also may be made of molded plastic is shown in FIG. 7 and comprises a vertical cylindrical portion '50 and a skirt 52. The lower end of the cylindrical portion 50 extends sufficiently to leave a space for the knotted end of a string or cord which enters through the hole 54. Since the components of the golf tee assembly in accordance with the invention may be made of molded plastic, it is possible to mold the golf tees and retaining means very easily to any of the desired configurations.

To use the golf tee assembly of the preferred embodiment of the invention, the retaining ring, such as indicated as 20 in FIG. 1, is placed over the rubberized practice tee 40 or laid directly on a teeing ground surface. The anchoring means is inserted into the ground or the practice tee through the ring to secure the ring to the ground or make a tight fit with the practice tee. The golfer may select the particular golf tee of desired height for practicing with various golf clubs. For example, the golf tee with the least vertical elevation may be used for practicing with short and medium golf club irons. The intermediate golf tee can be used with fairway woods and long golf club irons and the highest elevation golf tee can be used for drivers and number 1 or 2 woods. When striking the ball off the golf tee, the retaining ring and golf tees will simply rotate around the rubberized practice tee and/or the elongated shaft of the anchoring means and can be reused since they will not be lost or otherwise discarded.

In an alternative embodiment the retaining member is attached to the anchor means and together comprise an integral unit. In this case, the configuration of the retaining member may be a wide flange around the elongated shaft, or the retaining member can be in the form of the retaining rings as previously described. The retaining member and anchor means may be made of molded plastic, etc., as a unitary structure. The flexible attaching means are attached to the retaining member portion as previously described.

Figure 8:
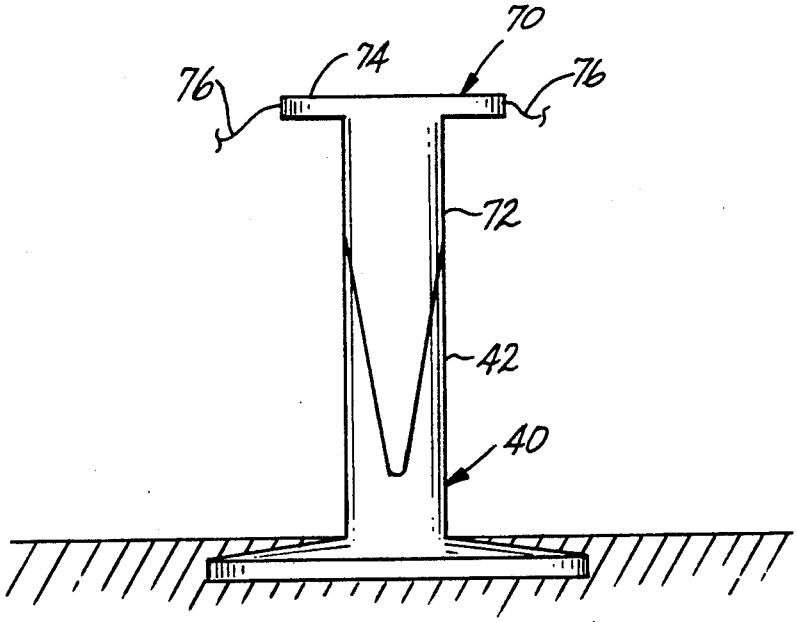
FIG. 8 is a side elevation view of an alternative embodiment of the invention wherein the retaining member is attached to the anchoring means.

As can be seen in FIG. 8, the golf tee assembly in this embodiment comprises anchoring means comprising an elongated shaft 72 with retaining member portion 74 attached thereto or as a component of a unitary structure. Flexible attaching means 76 are attached at one end to the retaining member 74, and at the opposite end to the golf tees, not shown. The elongated shaft 72 has a tapered end portion which is insertable into the hollow cylindrical member 42 of a practice tee 40 to form a tight fit therewith, thereby securing the golf tee assembly to the practice tee. Retaining member 74 may be also formed with a knob or other structure. Thus, the grasping end portion of the elongated shaft may comprise the retaining member itself or some other structure affixed thereto or made a part thereof.

It is apparent from the foregoing, that the present invention provides a convenient and inexpensive device that permits golfers to practice with golf tees of different heights on artificial grass or other surfaces. Thus, instead of the single practice tee which may be found in most driving ranges, use of the invention enables the golfer to bring along a simple device that will permit practice of all golf shots and which enables the use of golf tees of appropriate height on a consistent basis when practicing a particular golf shot.

The golf tees and the retaining ring may be made of any suitable material such as plastic, rubber, wood, metal, etc. and the flexible attaching means may comprise string, cord, twine or other similar material and may also be elasticized if desired. It is noteworthy that since the retaining ring is anchored, it may be made of lightweight inexpensive material instead of the heavy material used as weights in prior devices. As indicated previously, various techniques may be used to fasten the flexible attaching means to the golf tee and the retaining ring.

Use of the anchoring means as described enables the invention to be used with a standard practice tee and, in addition, since such practice tees are typically made of flexible rubber, provides additional support for the hollow cylindrical member of the practice tee.

Although the anchoring means used in accordance with the invention has been described with a circular grasping end, it is obvious that this configuration may be varied. Thus, the grasping end can be cylindrical, egg shaped, cubical, etc., as long as it is of a cross section larger than the hole in the retaining ring. Similarly, the elongated shaft of the anchoring means is advantageously tapered in the manner described. However, it does not need to be tapered along its entire length.

It is apparent from the foregoing, that various changes and modifications may be made without departing from the spirit of the invention, accordingly, the scope of the invention should be limited only by the appended claims wherein:

What is claimed is:

1. A golf tee assembly with reusable golf tees for use on a teeing ground surface comprising:

a plurality of unconnected, individual golf tees of different vertical elevation, each tee having an upper surface configured to support a golf ball placed thereon;

golf tee retaining means separate from said golf tees, said means having a hole therethrough;

a plurality of elongated attaching means extending from said golf tee retaining means for individually attaching said golf tees to said golf tee retaining means and remote therefrom, each said attaching means being fixed at one end to said golf tee retaining means and at the other end to a respective golf tee;

anchoring means insertable through the hole in said golf tee retaining means for securing said golf tee retaining means to the teeing ground surface, said anchoring means comprised an elongated shaft with a tapered, piercing end portion and an opposite grasping end portion;

a practice tee with a hollow, cylindrical member secured to the teeing ground surface and extending through the hole in said golf retaining means, the tapered piercing end of said elongated shaft of the anchoring means being insertable into the hollow cylindrical member of said practice tee so as to form a friction fit therewith and the grasping end of said elongated shaft of the anchoring means serving to maintain said golf tee retaining means around said practice tee.

2. A golf tee assembly according to claim 1 wherein said anchoring means comprises an elongated shaft with a tapered, piercing end portion and an opposite grasping end portion; said retaining member comprises an annular ring with a central hole and said grasping end portion of said anchoring means is of a cross section greater than a cross section of the central hole of said annular ring.

3. A golf tee assembly according to claim 1, wherein said golf tees are of frusto-conical shape.

4. A golf tee assembly according to claim 1, wherein said golf tee retaining means comprises an annular ring.

5. A golf tee assembly according to claim 4, wherein said flexible attaching means comprises string connected at one end to the golf retaining means and at the opposite end to a golf tee.

6. A golf tee assembly according to claim 1, wherein said teeing ground surface comprises a carpet or mat having an aperture therethrough and said practice tee further comprises a flange portion attached to and extending from said cylindrical member, said flange portion being adapted to be disposed under said carpet or mat when said cylindrical member extends upwardly through said aperture therein.

7. A golf tee assembly according to claim 1, wherein said elongated attaching means are flexible.

8. A golf tee assembly with reusable golf tees for use on a teeing ground surface comprising:

a plurality of unconnected, individual golf tees of different vertical elevation, each tee having an upper surface configured to support a golf ball placed thereon;

golf tee retaining means separate from said golf tees, said means having a hole therethrough;

a plurality of elongated attaching means extending from said golf tee retaining means for individually attaching said golf tees to said golf tee retaining means and remote therefrom, each said attaching means being fixed at one end to said golf tee retaining means and at the other end to a respective golf tee;

anchoring means for securing said golf tee retaining means to the teeing ground surface, said anchoring means comprising an elongated shaft with a tapered, piercing end portion; and a practice tee with a hollow, cylindrical member fixed to a teeing ground surface, the piercing end of said elongated shaft of said anchoring means being insertable into said hollow cylindrical practice tee so as to form a friction fit therewith thereby removably securing said anchoring means to said practice tee.

9. A golf tee assembly according to claim 8, wherein said golf tees are of frusto-conical shape.

10. A golf tee assembly according to claim 8, wherein said teeing ground surface comprises a carpet or mat having an aperture therethrough and said practice tee further comprises a flange portion attached to and extending from said cylindrical member, said flange portion being adapted to be disposed under said carpet or mat when said cylindrical member extends upwardly through said aperture therein.

* * * * *